United States Patent [19]

McArdle

[11] 4,169,343

[45] Oct. 2, 1979

[54] MULTIPACKAGING METHOD AND APPARATUS

[75] Inventor: Edward J. McArdle, Morton Grove, Ill.

[73] Assignee: Illinois Tool Works Inc., Chicago, Ill.

[21] Appl. No.: 908,593

[22] Filed: May 22, 1978

Related U.S. Application Data

[63] Continuation-in-part of Ser. No. 828,002, Aug. 28, 1977, abandoned.

[51] Int. Cl.[2] ..... B65B 27/04

[52] U.S. Cl. ..... 53/398; 53/48

[58] Field of Search ..... 53/398, 48, 49, 580

[56] References Cited

U.S. PATENT DOCUMENTS

| | | | |
|---|---|---|---|
| 2,646,911 | 7/1953 | Holmberg | 53/48 |
| 3,073,086 | 1/1963 | Martin et al. | 53/48 X |
| 3,628,305 | 12/1971 | Owen et al. | 53/48 X |
| 3,760,554 | 9/1973 | Arneson | 53/48 X |
| 3,775,935 | 12/1973 | Schlueter et al. | 53/48 |

*Primary Examiner*—Travis S. McGehee

*Attorney, Agent, or Firm*—Edward L. Benno; Thomas W. Buckman; Robert W. Beart

[57] ABSTRACT

A multipackaging method and apparatus for multipackaging containers with a stretchable plastics material device or carrier that essentially uses the containers as the carrier applicating elements.

15 Claims, 22 Drawing Figures

31
28
26
27
24
10
37
10
24
31
28
26
27
32
36
35
32
28
24a
24a
28
26
27
26
27
38
21

10
37
10
24
24
36
35
38
41
40
43
42

24
10
10
24
37
36
35
41
40
43
42

MULTIPACKAGING METHOD AND APPARATUS

This application is a continuation in part application of my pending application Ser. No. 828,002, filed Aug. 28, 1977; now abandoned.

BACKGROUND OF THE INVENTION

Many different types of multipackaging methods and apparatus are known in the art for multipackaging containers with a stretchable plastics material carrier or device. Representative methods and machines of that art are shown in the following U.S. Pat. Nos.: 2,864,212; 2,929,181; 3,032,943; 3,032,944; 3,383,828; 3,404,505; 3,407,563; 3,611,656; 3,621,628; and 3,742,677.

As the prior art shows, while the containers are essential elements in the operation of those machines, and while to some degree the containers may hold part of a carrier during the application procedure, in no instance is the container itself used as the primary carrier applying element.

SUMMARY OF THE INVENTION

As opposed to the teachings of the prior art, the present invention involves using the containers as the primary elements for applying a stretchable plastics material carrier to the containers to multipackage the containers. To so function in the method and apparatus of the invention, the containers must be used in opposed pairs.

Briefly and basically, the invention involves taking a pair of containers and moving them together or tilting them toward each other so that the ends of the containers to which the carrier is to be applied are within the openings or apertures of the carrier bands to be applied to the containers. A pair of carrier bands comprising closed loops and the close ends of the containers are relatively brought together, such as by merely draping the carrier onto the containers, with each band over one of the close container ends of the pair of containers, and with the furthermost opposed portions of the pair of bands engaging the furthermost opposed sidewall surface portions of the close container ends of the pair of containers. The pair of containers are then moved apart or tilted in opposite directions which moves the furthermost opposed sidewalls outwardly relative to each other to tension or stretch the pair of carrier bands. As that latter movement or tilting occurs, properly initially formed bands of the pair of bands will tend to move in both directions from the initially engaged sidewall surface portions of the containers about the remainder of the sidewall surface of each of the containers. With some container end shapes, and with some carrier band shapes, that latter movement apart or opposite tilting can result in a complete application of the carrier to the containers. With other container end shapes and with other carrier shapes and stretching characteristics, the containers with the partially applied bands can be moved beneath a plow-like element which will, upon relative axial movement between that element and the containers, in effect exert a force toward and between the containers and against the carrier to cause complete application of the carrier to the containers.

Although the invention as shown in the drawings uses a continuous carrier strip of two rows of container bands in one embodiment and three rows in another embodiment, the invention contemplates that the carrier strip may comprise any selected number of intermediate bands between the two outboard rows of bands. A carrier of three rows of bands is shown for example in U.S. Pat. No. 4,018,331. The method and apparatus of the invention contemplate that where the carrier strip includes intermediate rows of bands, concurrently with or after application of the outboard bands to the two rows of containers, the two rows of containers are moved or held apart in a transverse direction to stretch or tension the intermediate rows of bands. A number of intermediate rows of containers equal to the number of rows of intermediate bands are then moved relatively toward and into axial alignment with the intermediate bands to progressively force the intermediate containers through the intermediate bands. If necessary, plow-like elements as will be hereinafter described in detail may be used on the opposite surface of the intermediate bands from that engaged by intermediate containers to aid in complete encirclement of the intermediate containers by the intermediate bands.

Where the carrier strip is a continuous strip of indeterminate length, some known cutting means may be used to transversely sever the carrier strip between applied carrier bands to form multipackages of a selected number of containers in each row. The method and apparatus of the invention contemplates that the multipackages formed in the use of the invention need not be merely consumer packages, but may also be distributor packages. Such distributor packages for example, can comprise a package large enough in row lengths and numbers of rows to cover the entire surface of a standard shipping pallet.

The method and apparatus of the invention further contemplates that the containers need not be merely cylindrical cans such as shown in the drawings, but may be bottles, boxes or containers of other shapes which can be multipackaged by practicing the invention.

The method and apparatus of the invention further contemplates that the carrier may take other shapes and forms from that shown in the drawings. For example each container band may have an integral cover portion, such carriers being shown for example in U.S. Pat. Nos. 3,331,500 and 3,784,002.

The primary object of the present invention is to provide a multipackaging method and apparatus for multipackaging containers with a stretchable plastics material carrier in which the method and apparatus essentially uses the containers in opposed pairs as the carrier applicating elements.

Other objects and features of the invention will be apparent upon a perusal of the hereinafter following detailed description read in conjunction with the drawings.

DETAILED DESCRIPTION OF THE PREFERRED EMBODIMENTS

By way of example the drawings show one type of container that can be used to practice the subject invention as cylindrical cans having an upper chime, and the carrier or multipackaging device as comprising two rows in one form and three rows in another form of container bands integrally interconnected in rows and ranks.

Many different forms of carrier structures may be used in the practice of the present invention. Such carriers may be seen for example in U.S. Pat. Nos. 3,733,100; 3,778,096; 3,874,502; 4,018,331; 3,331,500 and 3,721,337. A preferred form of carrier is one in which the container receiving apertures are elongated in the direction of the carrier strip for relatively easy initial capturing engagement by the containers. Preferably, the carriers are in the form of a long strip permitting substantially continuous application, and are formed from a resilient elastic plastics material such as low density polyethylene. Further, the inner peripheral dimension of each of the bands is preferably smaller than the outer circumferential dimension of the area of the containers to which the carrier is to be applied so that the carrier bands in a stretched applied condition will grippingly encircle and hold the containers.

Figure 9:
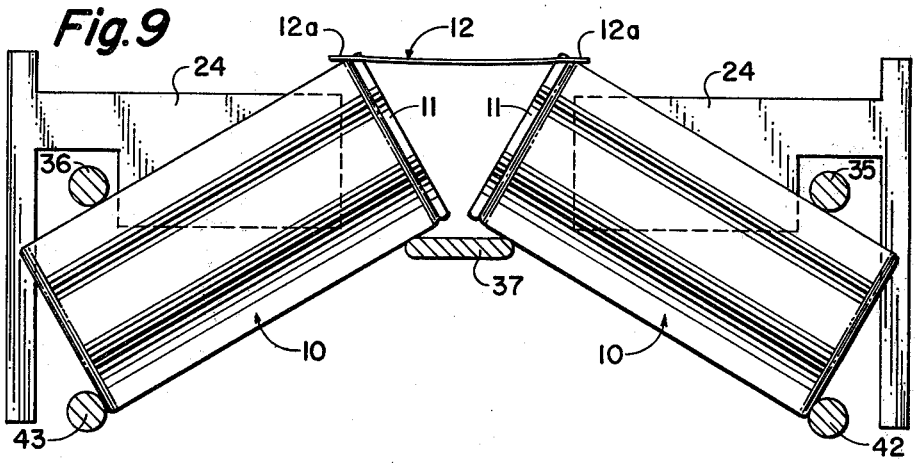

One embodiment of the basic method of the invention may be understood by viewing FIGS. 8–13 of the drawings. As may be seen therein, containers 10 are firstly arranged as in FIG. 8 in opposed pairs with the longitudinal axes intersecting in an obtuse angle. Thus as may be seen in FIG. 8, two edge portions of the two container tops 11 are closer together than any other portions of the tops 11 with the top edge portions which are diametrically opposed from the edge portions of closest spacing being of furthermost spacing. The containers 10 must be tilted sufficiently so that the top edge portions thereof of furthermost spacing are spaced apart a distance less than the distance between the inner peripheries of the transversely outwardmost band portions of the bands of the carrier 12. That initial alignment of the containers 10 permits the carrier 12 to be draped or applied as shown in FIG. 9, where the carrier 12 is shown in a transverse edge view, with the transversely outwardmost band portions 12*a* over the chimes and against the upper sidewall surfaces of the opposed containers 10.

Figure 10:
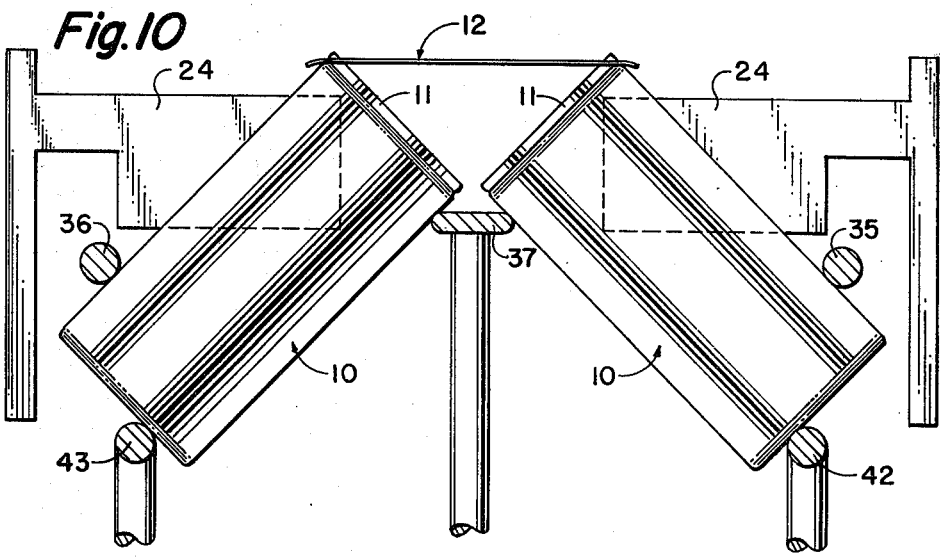
Figure 13:
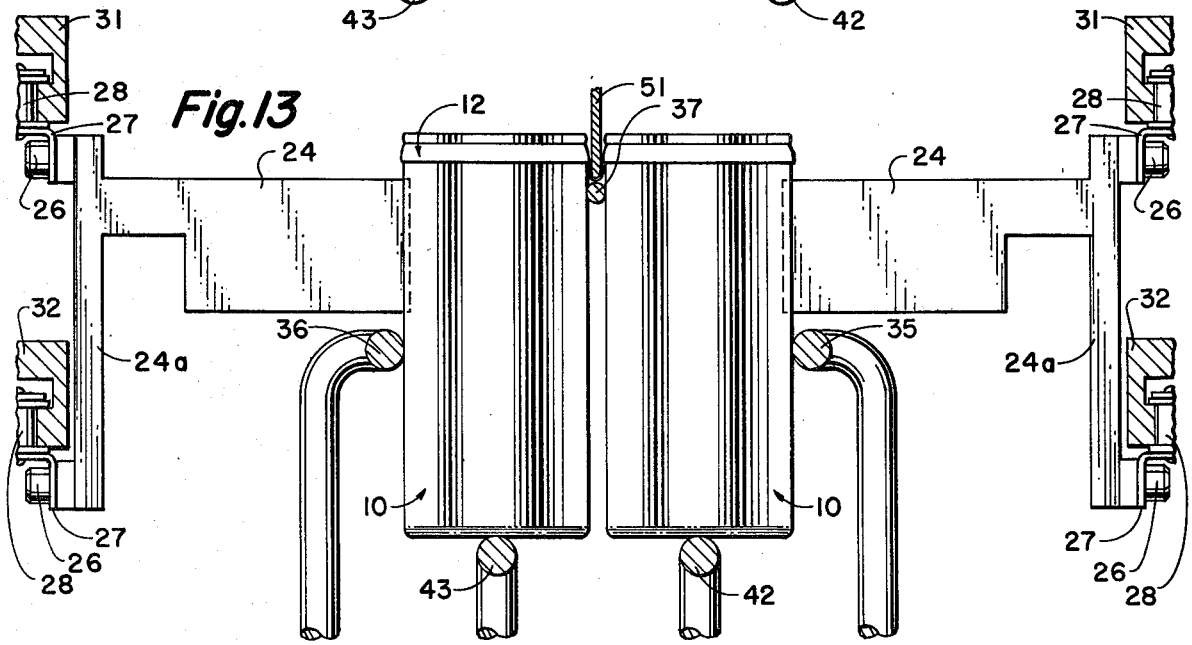

The next step in the method is shown in FIG. 10, and that step involves a tilting of the containers 10 toward the parallel axes position shown in FIG. 13. In that manipulation of the containers 10, the chimes, on the top 11 and the outer sidewall surfaces of the containers 10 will tend to capture or hold onto the two outer band portions of the transversely opposed bands of the carrier 12. Depending upon the particular carrier band configuration and transverse dimension of the carrier relative to the size of the containers 10, the described tilting action step toward the parallel axis position of FIG. 13 may also have to be accompanied by a movement of each opposed pair of containers 10 apart to insure that the carrier bands are stretched and tensioned against the engaged outer surfaces of the containers 10.

Figure 11:
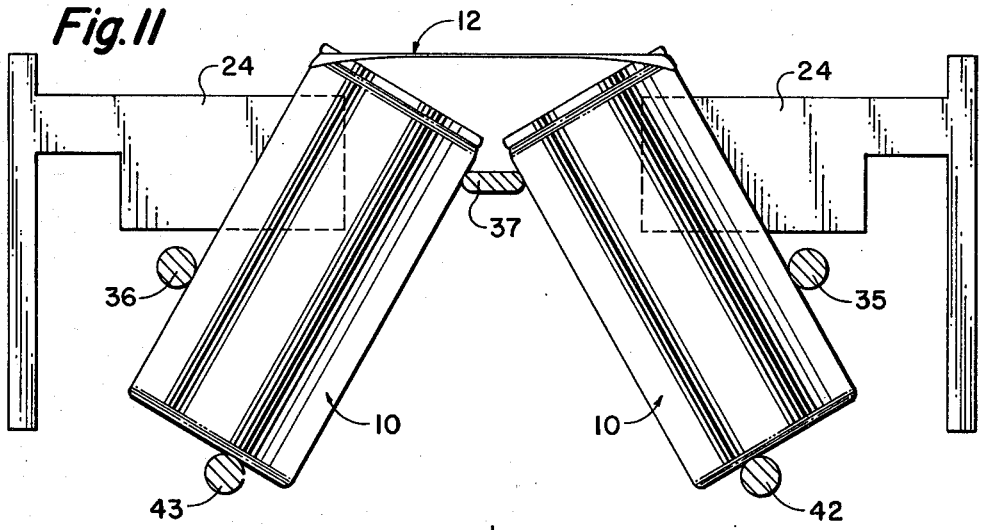

As tilting of the containers 10 further proceeds through the position shown in FIG. 11 and toward the parallel axis position shown in FIG. 13, the container bands will progressively slide over and encircle more and more of the outer surfaces of the containers 10.

With some carrier and container configurations it will be found that a continuation of the described container movements and carrier stretching actions will result in a complete encirclement of each carrier band about one of the containers 10. With other carrier and container configurations a further step in the method of the invention will involve the application of a force in the direction of the arrow 13 shown in FIG. 12 contemporaneously with the tilting action to insure the encirclement of each container 10 by one of the carrier bands. In the embodiment of the machine described hereinafter that force is effectively applied by a plow-like fixed member or hold-down blade shown immediately below the arrow 13 in FIG. 12 with the longitudinal central portion of the carrier 12 being urged downwardly as the underside of the plow-like member is inclined downwardly toward the output end of the machine. Alternatively, the relative movement of the containers 10 upwardly toward the blade-like element will accomplish the desired results as well.

In practicing the method of the invention with a carrier of more than two rows of bands such as shown in FIGS. 15–22, a number of alternative arrangements may be practiced for using the containers to apply the carrier thereto. In some arrangements the two outboard rows of bands are first applied to two rows of containers as described above. Thereafter the two outboard rows of containers with the longitudinal axes of the containers being maintained parallel, are moved or maintained transversely apart to render the intermediate rows of bands taut and tensioned. In addition to rendering the intermediate bands taut, carrier configurations in which the intermediate bands are initially elongated in the direction of the rows will require sufficient spreading of the outboard rows of containers to stretch the intermediate bands so that the apertures approximate the shape of the intermediate containers. The next step in the method of more than two rows of containers involves the movement of each intermediate row of containers axially toward the tensioned intermediate bands. With some carrier and container configurations, the ends of the intermediate containers can be merely pushed through the apertures of the intermediate bands. With some carrier and container configurations it may be preferred to tilt the intermediate containers in a vertical plane between the rows of outboard containers and through the intermediate bands so that one top side edge of each container initially passes through the aperture of an intermediate band. In such an arrangement the intermediate containers may be thereafter tilted in the opposite direction to bring the longitudinal axes of the intermediate containers substantially perpendicular to the plane of the intermediate bands to produce progressive encirclement of the intermediate containers by the intermediate bands. The invention also contemplates an alternative method in which initial partial entrance of the intermediate row or rows of containers into the intermediate row or rows of carrier bands can occur substantially concurrently with the final application of the outboard carrier bands to the outboard rows of containers. In some instances in the practice of the method of the invention with more than two rows of containers, plow-like elements may also be used to aid in completing the application of the intermediate bands to the intermediate containers.

The drawings show two embodiments of a machine of the subject invention in sufficient detail to enable those skilled in the art to practice the invention by constructing a complete machine. Many standard well known parts necessary for the operation of the machine have been omitted in order to clearly and concisely describe the invention. Those standard omitted parts will be easily understood and supplied by persons skilled in this art.

Figure 1:
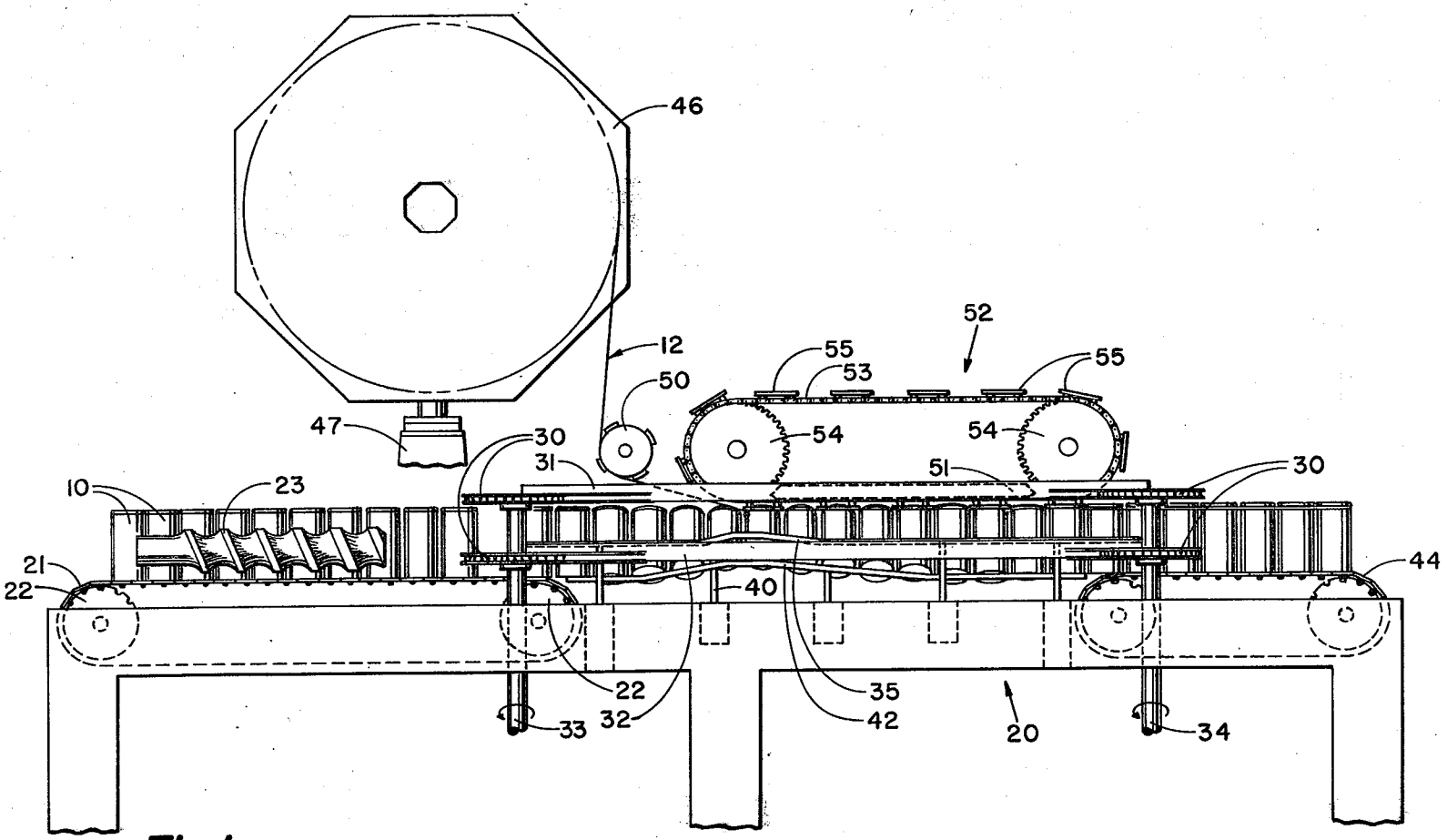
FIG. 1 is a side elevational view of one form of machine for practicing the invention.
Figure 2:
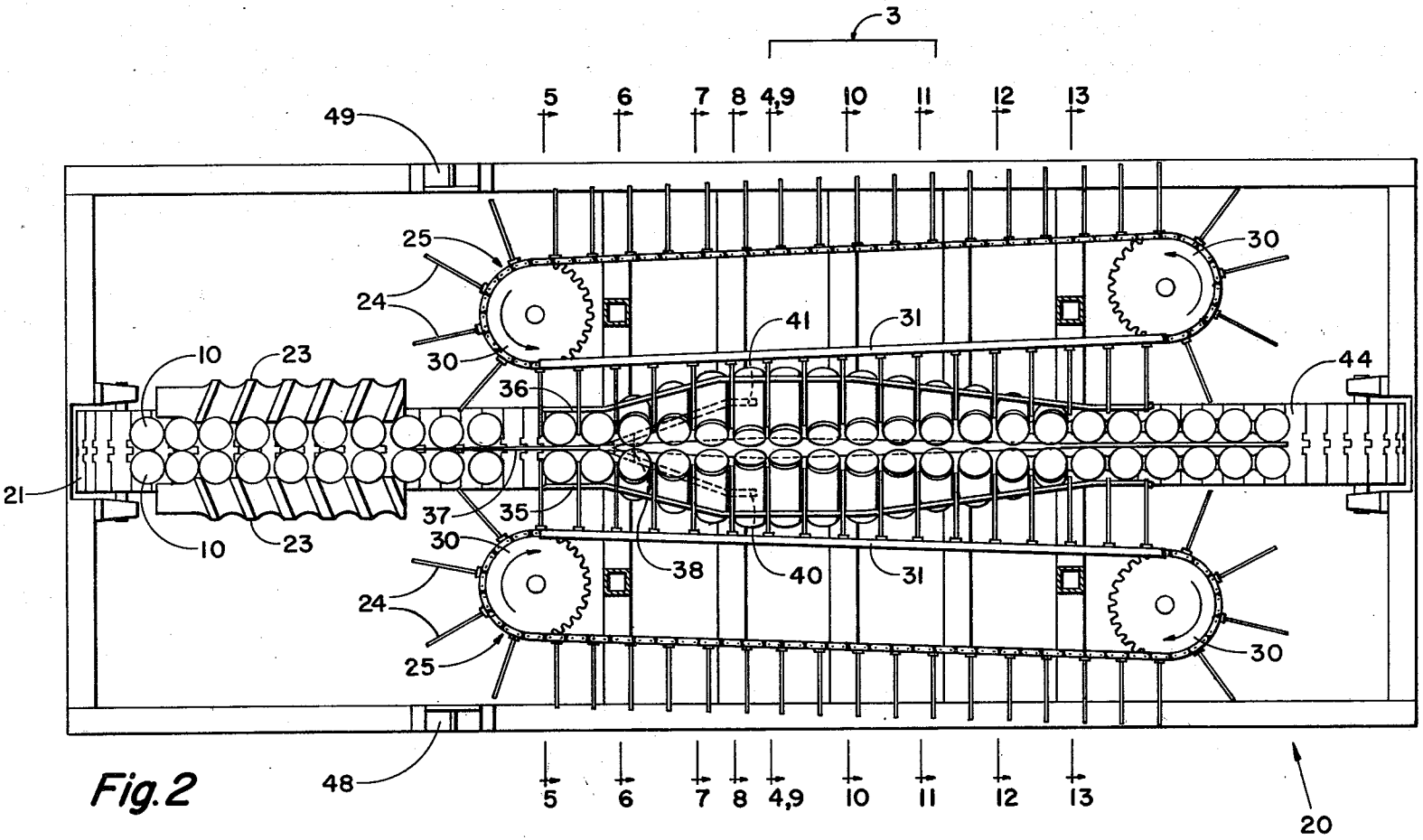
FIG. 2 is a top plan view of the machine of FIG. 1 with the carrier and carrier reel, feed roller, and carrier hold-down mechanism removed.

As shown in FIGS. 1 and 2, the machine comprises a frame 20 which supports the various elements of the machine. At the input end of the machine an input conveyor 21 is provided for carrying two rows of containers 10 into the machine. The input conveyor 21 is shown substantially diagrammatically as a continuous conveyor belt mounted on a pair of drive or sprocket wheels 22. Any known power source may be used to drive the conveyor 21 at an appropriate speed for a selected or desired machine operation speed. Above the conveyor 21 and on each side of the two rows of containers 10, a pair of screw elements 23 are provided. The screw elements 23 are mounted on suitable known driving and support means (not shown) for simultaneously rotating the screws 23 in opposite directions at a predetermined speed. The screws 23 in operation serve to accurately align and release each opposed pair of containers 10 for accurately spaced reception by the elements of the carrier applying stations of the machine.

As each opposed pair of containers 10 leave the output end of the screws 23, each such pair of containers 10 is picked up by the conveying fingers 24 of the two container conveyors 25. The fingers 24 and the chains on which they are carried are omitted in FIG. 1 to avoid obscuring the elements between the container conveyors 25.

Figure 5:
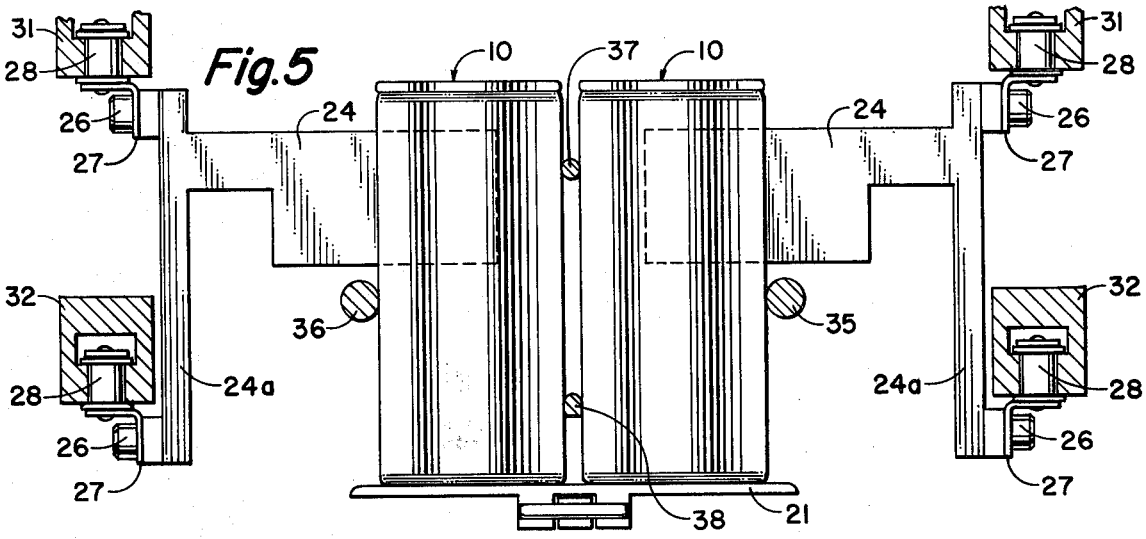
FIGS. 5–13 are views similar to FIG. 4 showing the central portion of the machine in cross section at various locations proceeding from the input end toward the output end of the machine, and viewed respectively substantially along the lines 5—5, 6—6, 7—7, 8—8, 9—9, 10—10, 11—11, 12—12 and 13—13 of FIG. 2.
Figure 6:
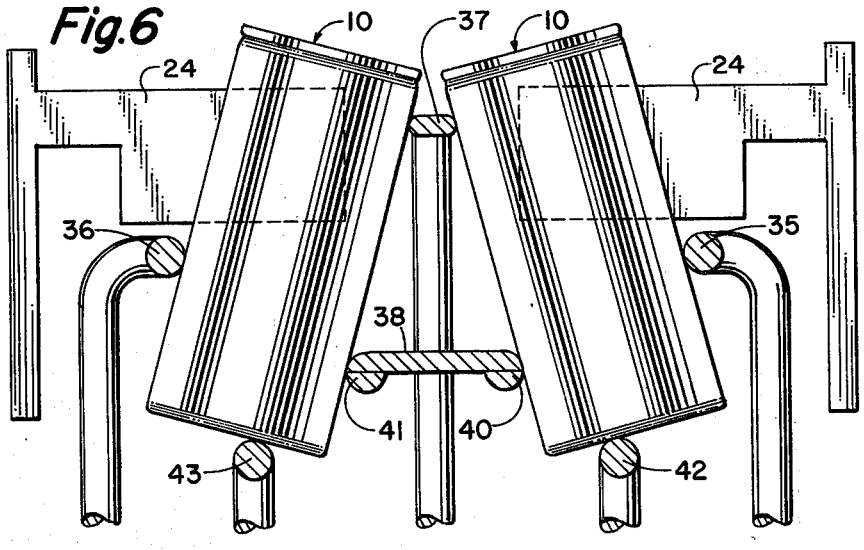
Figure 7:
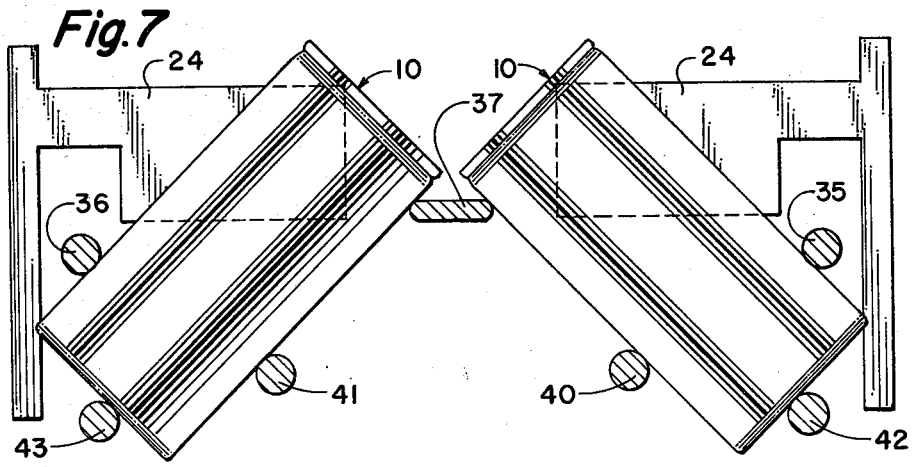
Figure 8:
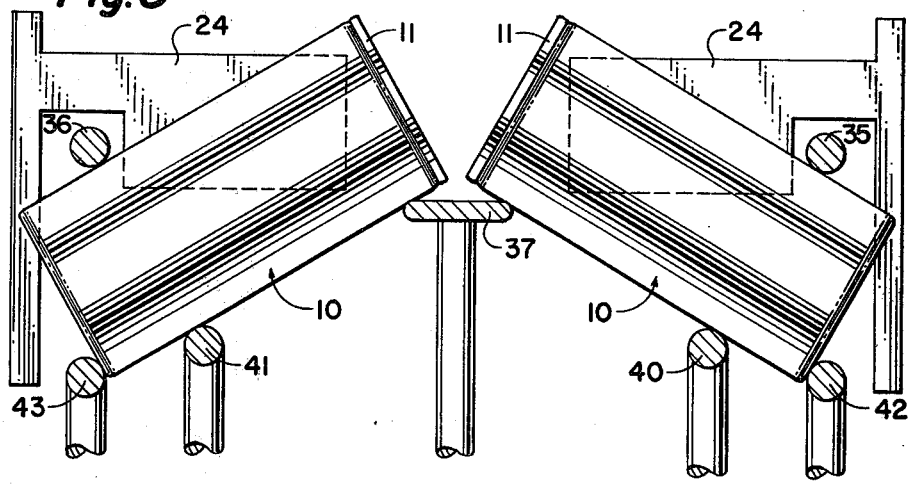

The fingers 24 are the elements for moving the containers 10 through the carrier applying stations of the machine. Those fingers 24 are shown in FIGS. 5–13 to show the manner in which they engage the containers 10 and FIGS. 5 and 13 partially show further details of the mounting of the fingers 24 in the container conveyor 25. As shown in FIGS. 5 and 13 each finger 24 has a vertically disposed base element **24*a*. The upper end of each base element 24*a* is secured by a fastener 26 to a L-shaped bracket 27. The L-shaped brackets 27 are in turn secured to pins of 4 continuous roller chains 23, two roller chains for each container conveyor 25. As may be seen in FIGS. 1 and 2, each roller chain 28 is carried about a pair of sprocket wheels 30 which are longitudinally spaced apart in the machine, there being an upper pair of sprocket wheels 30 and a lower pair of sprocket wheels 30 in each container conveyor 25. The inboard flight of each of the roller chains 28 is carried in a fixed channel member to maintain the inboard flights along substantially straight lines between the sprocket wheels 30. The upper chain 28 of each container conveyor 25 is carried in a channel member 31, and each lower chain 28 is carried in a channel member 32. The cross sectional configuration of the channel members 31 and 32 is shown in FIGS. 5 and 13. As may be seen in FIG. 2 as the sprocket wheels 30 are rotated in the direction of the arrows shown thereon, the fingers 24 urge each pair of opposed containers 10 through the carrier applicating stations of the machine. FIG. 1 shows the sprocket wheels 30 as carried on shafts 33 and 34. The shafts 33 and 34 are driven by known drive means (not shown) to move the containers 10 at substantially the speed of the input conveyor 21**.

As the container conveyors 25 move each opposed pair of containers 10 through the machine, each opposed pair of containers 10 is progressively tilted to and through the various positions as consecutively shown in FIGS. 5–13. The tilting motion is produced by a number of container guide elements extending longitudinally through the carrier applicating stations of the machine. Those guide elements may take different shapes from those shown as will be appreciated by those skilled in the art. To simplify the description of the invention, the guide elements are shown in the drawings in the relatively simple form of rods and plates.

At the input end of the carrier applying stations, the guide members are 4 in number, and they comprise a pair of rods 35 and 36 on the outboard side of each pair of opposed containers 10, and two members 37 and 38 between the two rows of cans 10, as may be seen in FIG. 5. FIG. 2 shows the rods 35 and 36 in top plan view and as they extend substantially completely through the carrier applicating stations of the machine. The rod 35 may also be seen in side elevation in FIG. 1.

The member 37 may be seen as a rod-like member between the two rows of containers 10 in FIG. 2. The member 37 widens from a rod-like members into a flat bar as it extends through the carrier applicating stations of the machine, and at the output end of the machine again becomes a rod-like member as shown in FIGS. 2 and 13. The cross sectional shape of the member 37 at indicated positions therealong is further shown in FIGS. 4–13.

The member 38 shown in FIG. 5 as a round member widens into a triangular plate which may be seen in FIG. 2 in dotted lines. Two rods 40 and 41 are each secured at one end thereof to the underside and wide end of the member 38 as may be seen in FIG. 6. From the member 38 the two rods 40 and 41 are angled apart substantially as shown in FIG. 2. Those rods 40 and 41 are further shown in cross section in FIGS. 7 and 8. Between the cross sectional views shown in FIGS. 8 and 9, the rods 40 and 41 are supported by a standard secured to the base 20 of the machine.

The guide members for the containers 10 further comprise a pair of bottom guide rods 42 and 43 which may be seen in FIG. 1 as beginning immediately after the input conveyor 21 and extending through the carrier applicating stations to terminate at the forward end of an output conveyor 44 shown in FIGS. 1 and 2. The bottom guide rods 42 and 43 in proceeding from the input end of the carrier applicating stations to the output end thereof are spread apart and brought together again as may be seen in the consecutive cross sectional views proceeding from FIG. 6 through FIG. 13. Various unnumbered supporting standards are secured between the guide members and the base 20 of the machine support the guide members as shown and described.

As noted above, the described guide members produce the container tilting actions such as is seen in FIGS. 5–13. That tilting action begins from the upright parallel axis position of the containers shown in FIG. 5 and results in a progressive tilt of the bottoms of the containers 10 outwardly with the upper ends of the containers 10 assuming the relative positions shown in FIG. 8 and 9. At about the tilt positions of FIGS. 8 and 9, the furthermost spaced apart portions of the container tops 11 are spaced apart a distance less than the distance between the inner peripheries of the transversely outwardmost band portions of a transverse pair of bands of the carrier 12. A top plan view of FIG. 9 is shown at the position indicated by the numberal 45 in FIG. 3, and that position is substantially the first position at which the carrier 12 has been draped onto the containers 10 for capture of the carrier 12 by the containers 10.

FIG. 1 shows a carrier delivery arrangement for the machine. A reel 46 having a long continuous strip of carrier 12 wound thereon is rotatively carried on a standard 47. The standard 47 is only partially shown in FIG. 1. Those skilled in the art will readily understand that the lower end of the standard 47 which is not shown will conveniently have a bifurcated lower end which will be mounted at 48 and 49 on the base 20 of the machine as shown in FIG. 2. The strip of carrier 12 is directed from the reel 46 about a feed roller 50 shown in FIG. 1. The feed roller 50 may be mounted by any known bracket arrangements on the base 20 of the machine and further driven by known arrangements in proper timed relation to the container conveyors 25 to drape or drop the carrier 12 onto the upper ends of the containers 10 as described. As the captured carrier 12 is held and stretched by each rank of containers 10 as the containers are tilted toward the upright position as shown in FIGS. 9–13, the bands of the carrier 12 will slide over and about the upper ends of the containers 10 to completely encircle them.

Figure 3:
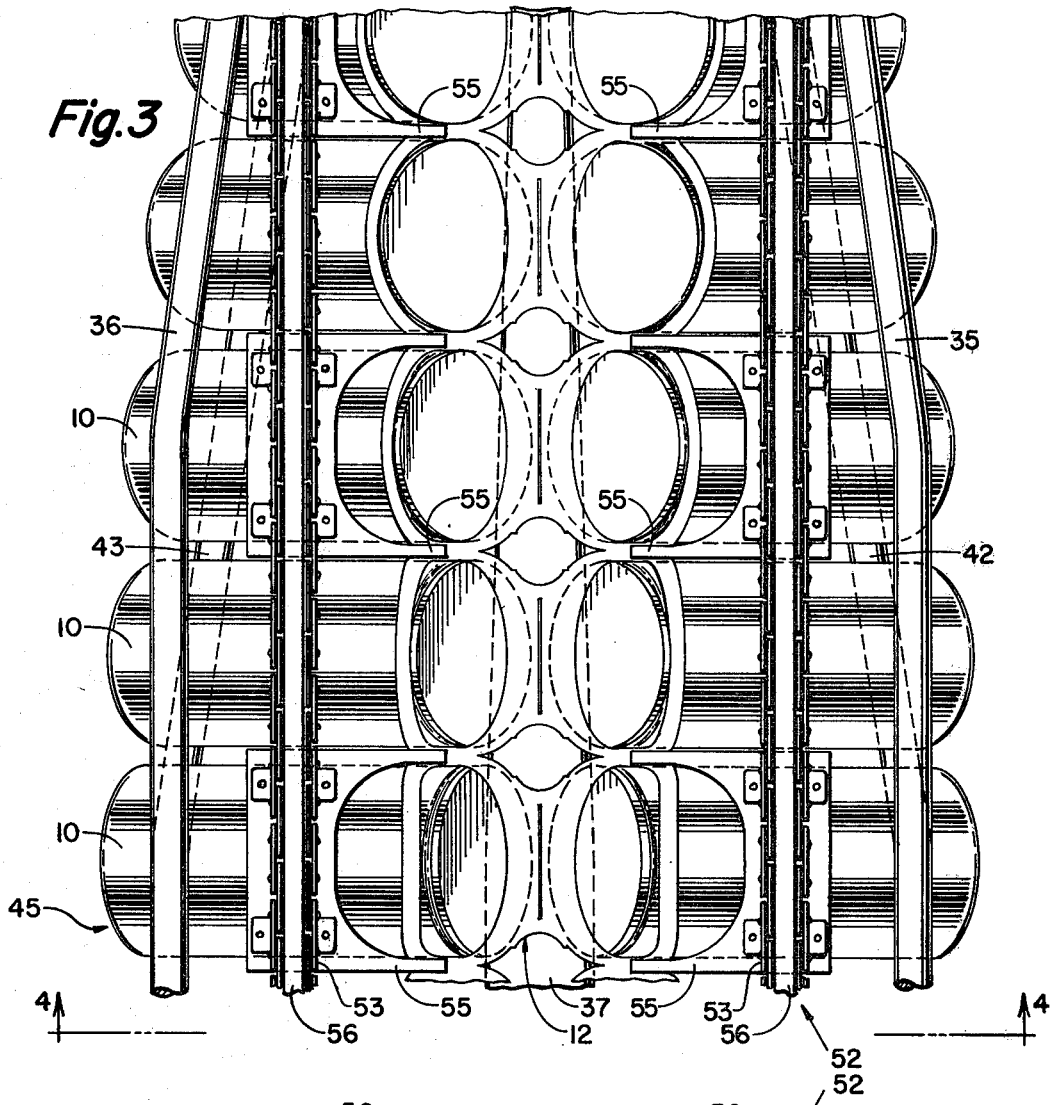
FIG. 3 is an enlarged top plan view of a portion of the machine shown in FIGS. 1 and 2 substantially within the area enclosed by the bracket numbered 3 in FIG. 2, and including the carrier and the lower flight of the hold-down mechanism shown in FIG. 1.
Figure 12:
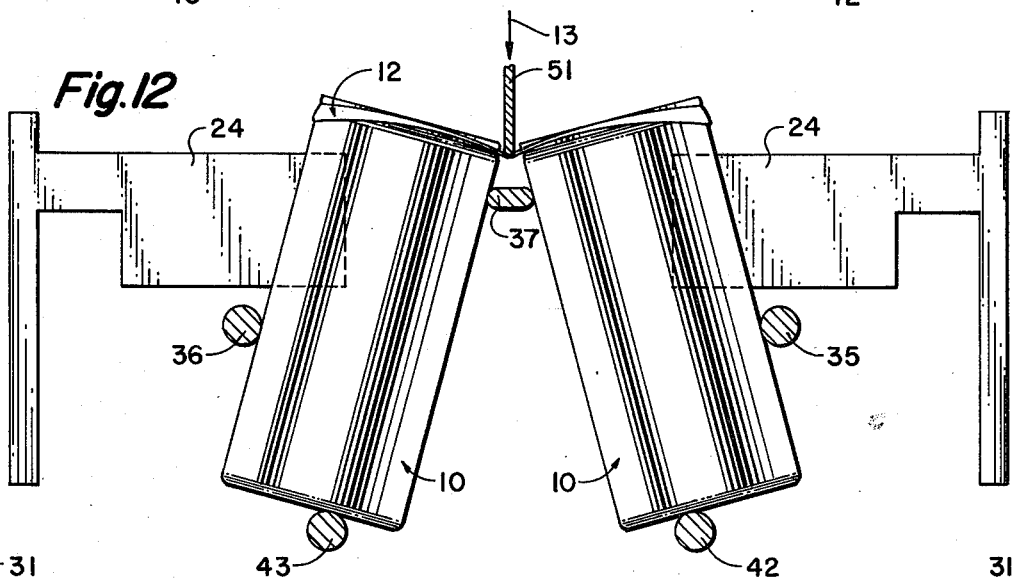

Those skilled in this art will understand that the best mode for the machine will be that which is most simple and of a minimum number of parts. Thus, if a particular shape of the containers 10 and the carrier 12 results in complete encirclement of each container by one of the bands of the carrier, the machine need not include any further elements in addition to those described above. However, in reductions to practice of the invention with cylindical cans such as cans 10 shown in the drawings and with a carrier configuration such as shown in FIG. 3, it was further desirable to provide the machine with a plow-like member 51 shown in dotted lines in FIG. 1. The plow-like member 51 comprises a plate that is carried from the base of the machine to be aligned in a vertical plane between the two rows of containers 10. Preferably, the lower edge of the fixed plow-like member 51 is inclined downwardly in the direction the containers 10 move through the machine so that as the containers 10 with the partially applied carrier 12 move beneath the plow-like member 51, the lower edge thereof progressively exerts a force on the upper side of the carrier 12 longitudinally centrally thereof to insure complete encirclement of the containers 10 by the carrier bands as shown in FIGS. 12 and 13.

Figure 4:
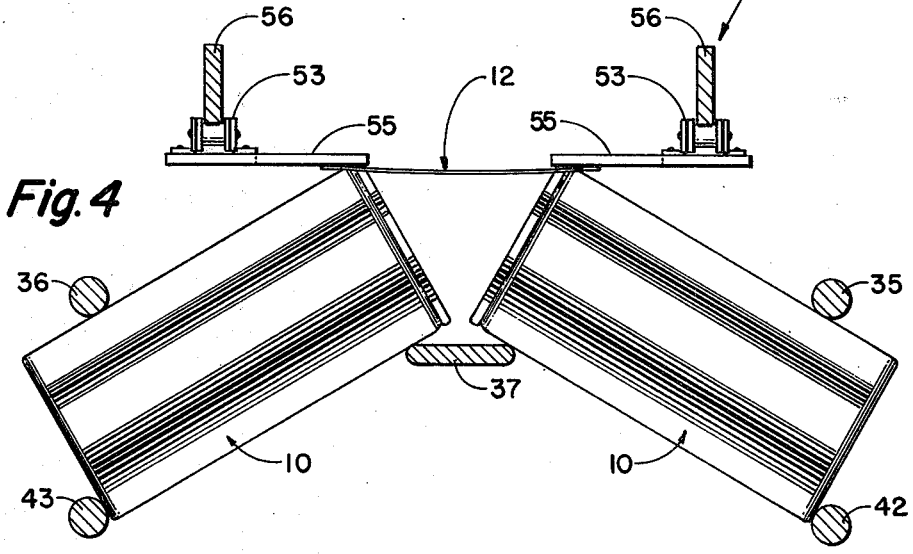
FIG. 4 is an end elevational view of the portion of the machine shown in FIG. 3 and viewed substantially along the line 4—4 of FIG. 3.

In some reductions to practice the invention it further appeared that a carrier hold-down mechanism would be advantageous to prevent accidental slipping of a carrier band from its associated container, particularly during the initial stages of association between the carrier and the containers. Such a carrier hold-down mechanism is shown in FIGS. 1, 3 and 4 at numeral 52. The carrier hold-down mechanism 52 comprises two continuous roller chains 53 with each roller chain 53 carried about a pair of sprocket wheels 54. Each pair of sprocket wheels 54 is rotatively carried in the machine for rotation about horizontal axes. The two pairs of sprocket wheels 54 are further spaced transversely apart to carry the roller chains 53 above the two rows of containers 10 as shown in FIGS. 3 and 4. Each roller chain 53 is provided with a plurality of U-shaped carrier hold-down brackets 55. The base portion of each hold-down bracket 55 is secured to one of the chains 53 as shown in FIGS. 3 and 4. The legs of each hold-down bracket 55 are spaced apart a distance sufficient to position each leg between an adjacent pair of containers 10 and against the web connecting adjacent bands of the carrier 12, such as shown in FIG. 3. The carrier hold-down mechanism 52 further includes a pair of vertical plates 56 shown in FIGS. 3 and 4. The vertical plates 56 are fixed in the machine to rest against the upper side of the lower flight of each chain 53 to maintain the hold-down brackets 55 against the carrier 12 between the containers 10 as shown in FIGS. 3 and 4. If desired, the hold-down brackets 55 may further be spring biased to produce a resilient holding force of the hold-down brackets 55 against the carrier 12. In some reductions of practice of the invention it has been found that the carrier hold-down mechanism 52 need not be driven other than by the containers 10 as the containers 10 are moved through the carrier applying stations of the machine by the fingers 24.

The output conveyor 44 which is shown substantially diagrammatically comprises a known conveyor chain assembly carried on a pair of horizontally spaced apart sprocket wheels. The output conveyor 44 is intended to be driven at substantially the speed of the fingers 24 and, as can be seen in FIGS. 1 and 2, receives the two rows of containers 10 with the strip of carrier 12 completely applied. If desired, a known cutting mechanism may be provided at the output end of the machine above the output conveyor 44 for transversely severing the carrier 12 between selected containers 10 to produce individual multipackages of a selected number of containers 10 in two rows. Such a mechanism may be seen in FIGS. 34 and 35 of U.S. Pat. No. 3,204,386.

FIGS. 14–22 of the drawings show further forms of the method and machine of the invention. Many of the parts of the machine of those figures are substantially the same as comparable parts in the machine of FIGS. 1–13 and therefore need not again be described in detail.

Figure 14:
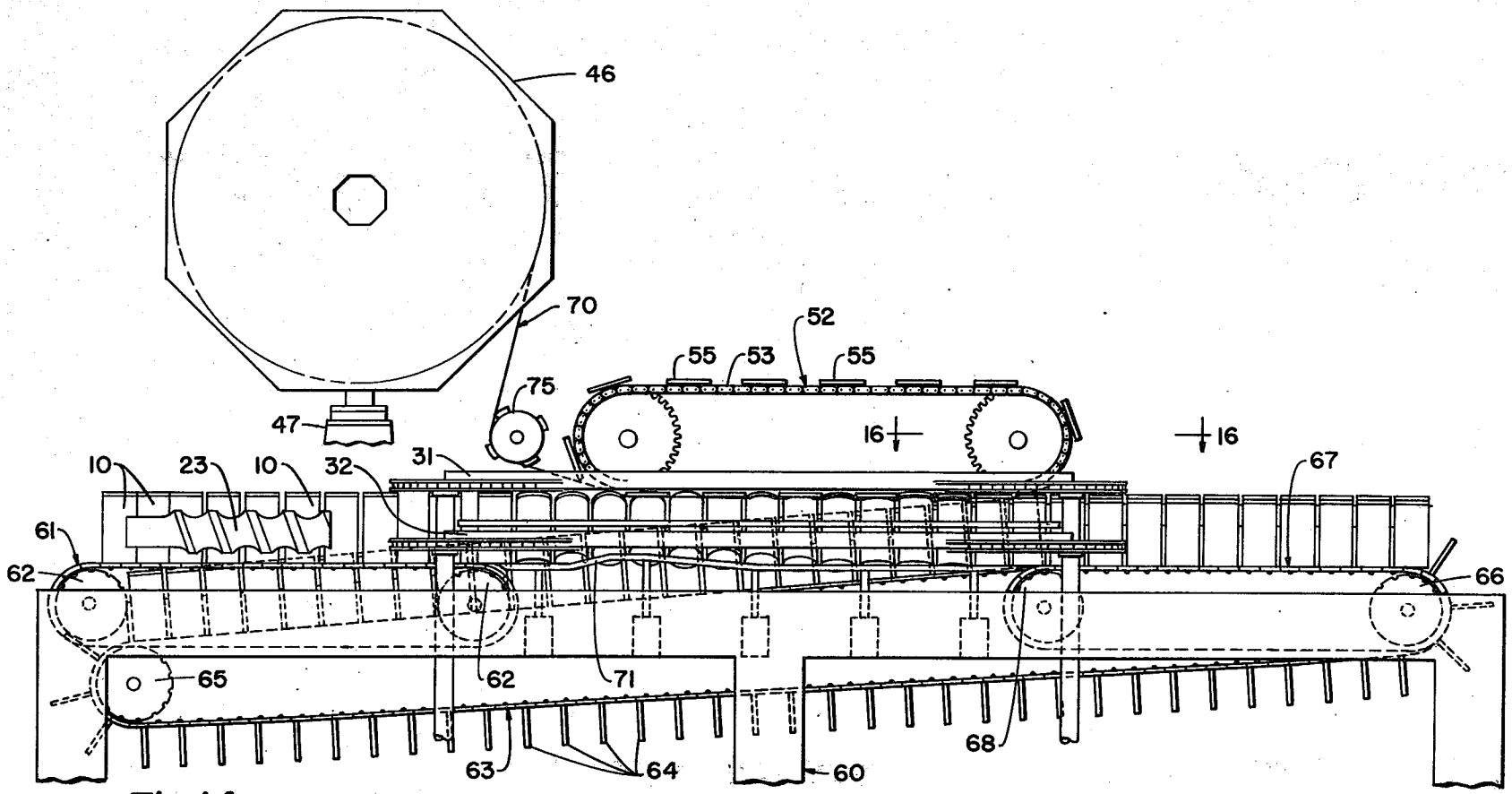
FIG. 14 is a side elevational view of another form of machine for practicing the invention.
Figure 15:
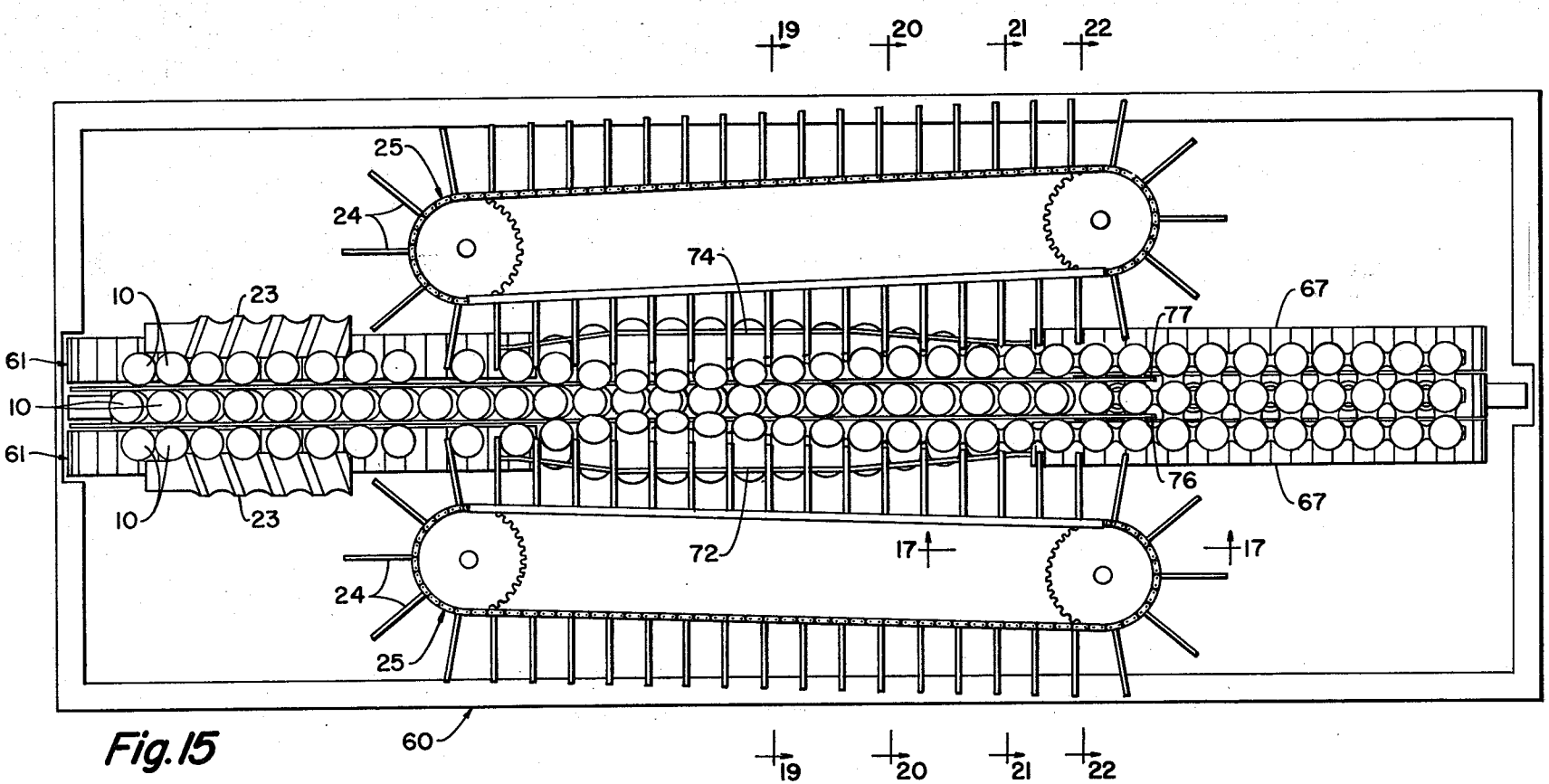
FIG. 15 is a top plan view of the machine of FIG. 14 with the carrier and carrier reel, feed roller, and carrier hold-down mechanism removed.

As shown in FIGS. 14 and 15, the machine is an embodiment of the invention for applying a carrier strip of three rows of container encircling bands to three rows of containers. In that machine a frame 60 supports the various elements of the machine. At the input end of the machine two input conveyors 61 are provided and operatively mounted on the frame 60 in a horizontally spaced apart relationship as can be seen in FIG. 15. Each of the input conveyors 61 carries one row of containers 10 into the machine. As shown in FIG. 14, each of the conveyors 61 comprises a continuous conveyor belt mounted about a pair of drive or sprocket wheels 62. Any known power source may be used to drive the conveyors 61 simultaneously at an appropriate speed for a selected or desired machine operation speed.

A third conveyor 63 is mounted on the frame 60 to carry a third or intermediate row of containers 10 into and through the machine. The conveyor 63 comprises a continuous conveyor belt mounted about a pair of driving or sprocket wheels and the conveyor belt is provided with extending fingers or plates 64 along its outer surface for positively moving the intermediate row of containers 10 through the machine. In the embodiment shown, the input end of the conveyor 63 is carried on a sprocket wheel 65 and the output end is carried on a sprocket wheel (not shown) behind the sprocket wheel 66 shown in FIG. 14. The sprocket wheel 66 carries the output end of an output conveyor 67. The input end of the output conveyor 67 is carried on a sprocket wheel 68. As shown in FIG. 15, two output conveyors 67 are provided, one on each side of the output end of the intermediate conveyor 63. The output conveyors 66 are operatively carried on the frame 60 and, if desired, need not be power driven conveyors in some embodiments of the machine where the intermediate conveyor 63 drives the containers 10 to which the strip of multipackaging devices 70 has been applied.

In the embodiment of FIGS. 14–22 the spacing between the containers 10 on the spaced apart conveyors 61 requires that the containers 10 of the outboard rows be tipped toward each other over the intermediate row of containers for reception of the outboard bands of the multipackaging devices of the strip 70 thereon. However, the invention contemplates other embodiments in which the two outboard rows of containers 10 are carried into the machine in an upright closely spaced attitude as the containers 10 are carried into the machine of FIGS. 1 and 2. In such an arrangement the outboard rows of bands of the multipackaging devices of the strip 70 can be draped or applied over the two rows of containers 10 without tipping or tilting the containers toward each other. However, in such an arrangement as opposed to the embodiment of FIGS. 14–22, the intermediate row of containers 10 cannot be brought upwardly toward the strip 70 until the outboard rows of containers 10 have been moved transversely apart a distance sufficient to admit the intermediate row of containers 10 therebetween.

Figure 16:
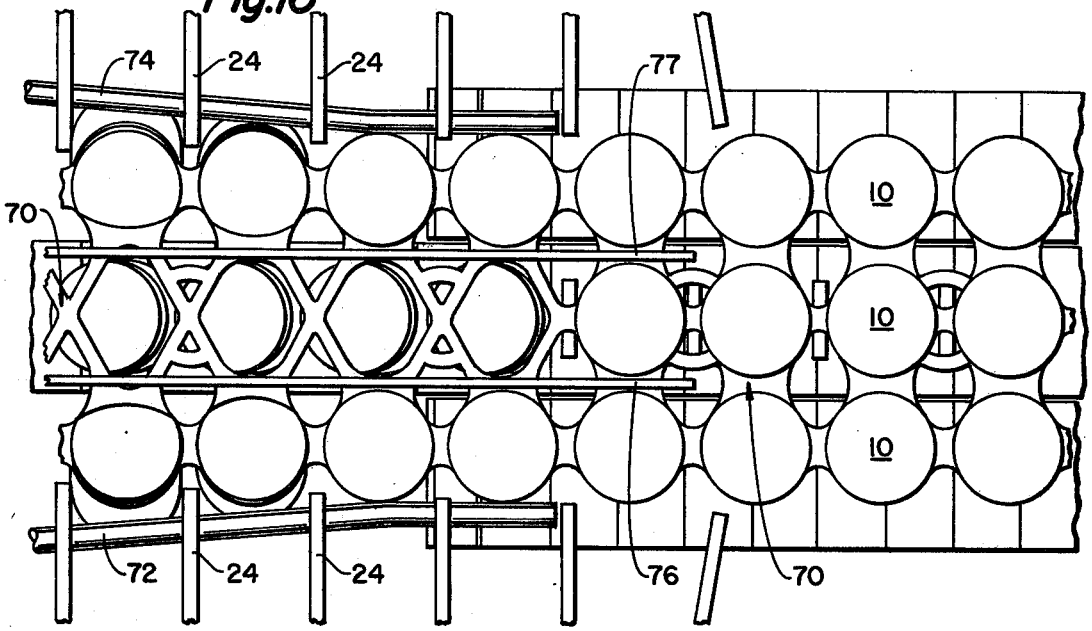
FIG. 16 is a fragmentary top plan view of a portion of the machine shown in FIGS. 14 and 15 and taken substantially along the line 16—16 of FIG. 14.

The strip 70 of multipackaging devices comprising three rows of container encircling bands is shown in a plan view in FIG. 16 and may further conveniently be made as the carrier strip shown in U.S. Pat. No. 4,018,331 mentioned above. Those skilled in this art will further understand from a study of the method and machine embodiment of FIGS. 14–22 that a carrier strip of more than three rows of bands can be applied to more than three rows of containers with a modified form of the machine of FIGS. 14–22. It may be seen that the intermediate conveyor 63 may be made wide enough to carry any selected number of intermediate rows of containers with a spreading apart of the conveyors 61 and 67 and the other conveying mechanisms associated therewith to admit a wider intermediate conveyor therebetween. In such other arrangements the two outboard rows of containers are carried into the machine with a spacing between the rows that will permit the outboard bands of the carrier strip to be captured by the outboard rows of containers. The outboard rows of containers are then gradually moved apart as those rows move through the machine, and when those rows are moved apart sufficiently to admit the intermediate rows of containers therebetween, the intermediate rows of containers are brought upwardly in a proper timed relationship to the movement of the outboard rows and through the apertures of the intermediate rows of bands of the carrier strip.

Similarly to the first described embodiment, the embodiment of FIGS. 14–22 includes a pair of screw elements 23 on each side of the outboard rows of containers 10 at the input end of the machine for accurately aligning and releasing each rank of outboard containers 10 for accurate spaced reception in the carrier applicating areas of the machine.

Figure 19:
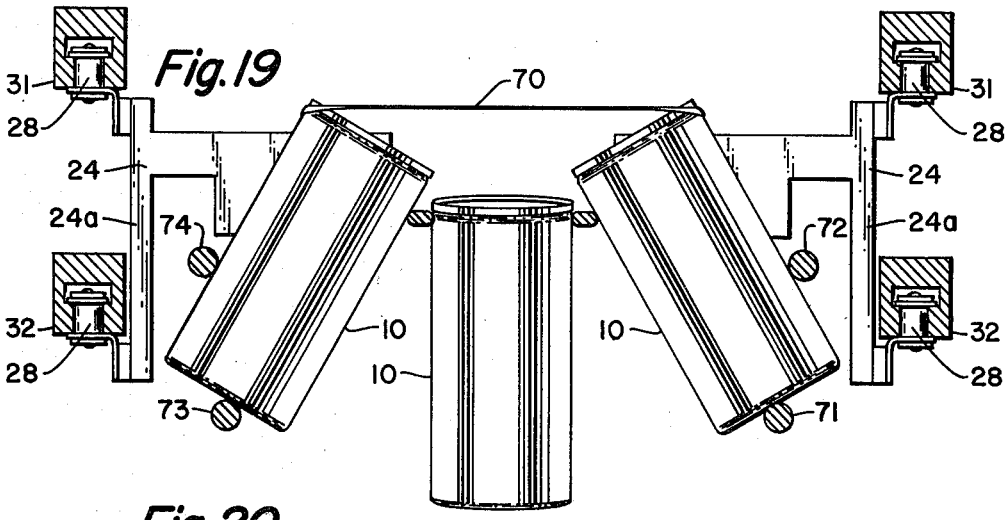
FIGS. 19–22 are fragmentary cross-sectional views taken respectively substantially along the lines 19—19, 20—20, 21—21, and 22—22 of FIG. 15 to show the operation of the machine in the area of carrier application to the intermediate row of containers.
Figure 20:
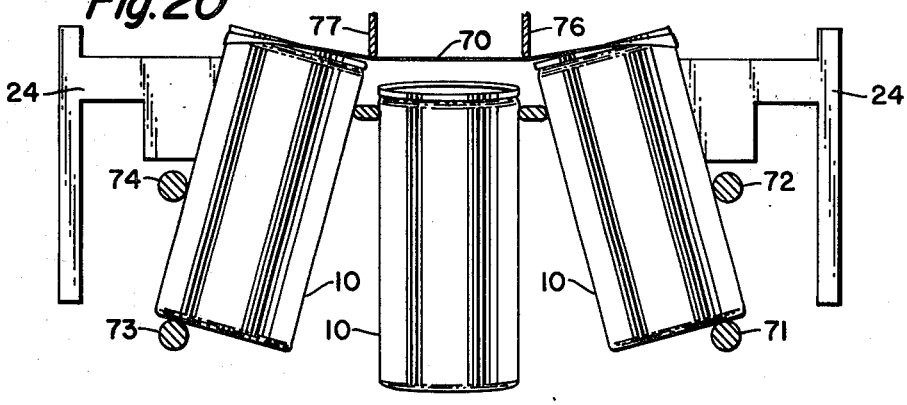

Two container conveyors 25 substantially identical to previously described conveyors 25 are provided and include conveyor fingers 24 for moving the outboard rows of containers through the carrier applying stations of the machine. The conveying fingers 24 are further shown in FIGS. 16 and 19–22. In FIG. 19 the numbered parts are the same as the identically numbered parts of the first embodiment and the construction of those parts need not be here described again in detail.

As the container conveyors 25 move each outboard row of containers 10 through the machine, the containers 10 are progressively tilted to and through various positions and particularly as consecutively shown in FIGS. 19–22. As in the first embodiment, the tilting motion is produced by a number of container guide elements extending longitudinally through the carrier applicating stations of the machine. Those guide elements function substantially as the above described guide elements 35–38 and are shown at 71–74.

A reel 46 having the strip 70 of carriers wound thereon is rotatively carried on a standard 47 supporting the reel 46 centrally over the machine and so that the strip 70 may be fed about a feed roller 75. From the feed roller 75 the carrier strip 70 is fed downwardly over the outboard rows of containers 10 and at the position where each successive rank of containers reaches the position of maximum tilt, the outboard band portions of the outboard rows of container encircling bands of the strip 70 are draped over the outwardmost opposed portions of each rank of container ends. At that position, the machine may further be conveniently provided with a carrier strip hold-down mechanism 52 shown in FIG. 14 and intended to be substantially the same as the like numbered mechanism described above relative to the first embodiment. Since the outboard rows of containers are further apart in the embodiment of FIGS. 14–22 than in the first described embodiment, the carrier hold-down mechanism 52 should be made wider so that the chains 53 are further apart and appropriately positioned to carry the hold-down brackets 55 against the outboard portions of the outboard rows of carrier bands and between the containers of the outboard rows of containers.

Figure 21:
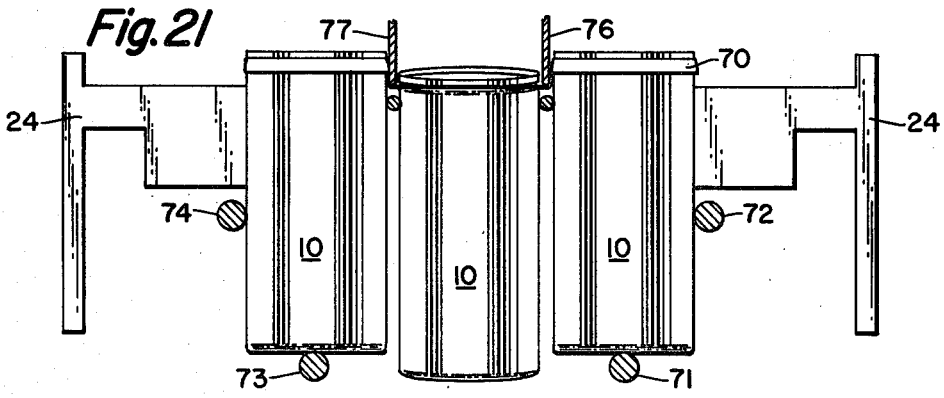
Figure 22:
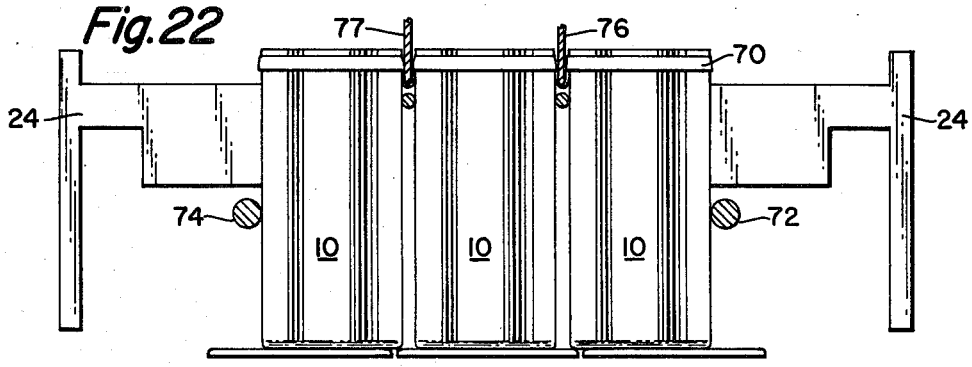

As the outboard rows of containers move from the position where the carrier strip 70 has been initially applied thereto, each rank of containers 10 in further moving through the machine are tipped toward the upright positions to clasp or capture the outboard band portions of the outboard bands of strip 70 such as shown in FIG. 19. As the tilting toward the upright position of the containers 10 continues, the strip 70 is stretched transversely and the bands begin to slide further and further over and about the upper ends of the containers 10. If necessary to aid in the complete application of the outboard carrier bands to the outboard rows of containers, a pair of plow elements 76 and 77 are provided. The plow elements 76 and 77 are shown in a top plan view in FIG. 15 and are carried by suitable brackets (not shown) secured to the frame 60 over and on each side of the intermediate row of containers 10. The lower ends of the plow elements 76 and 77 are further shown in FIGS. 20–22. As the containers 10 carry the carrier strip 70 beneath the plow elements 76 and 77, the carrier strip on each side of the intermediate row of bands is urged against the underside of the plow elements 76 and 77 to cause a relative downward movement of the outboard carrier bands completely about the outboard rows of containers 10 as shown in FIG. 21.

Figure 17:
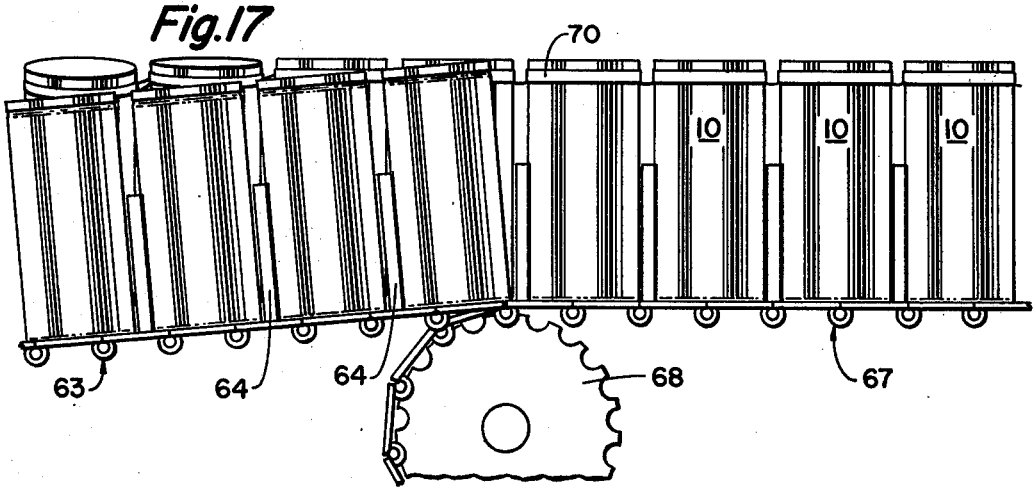
FIG. 17 is a fragmentary side elevational view of the machine shown in FIGS. 14 and 15 and taken substantially along the line 17—17 of FIG. 15.
Figure 18:
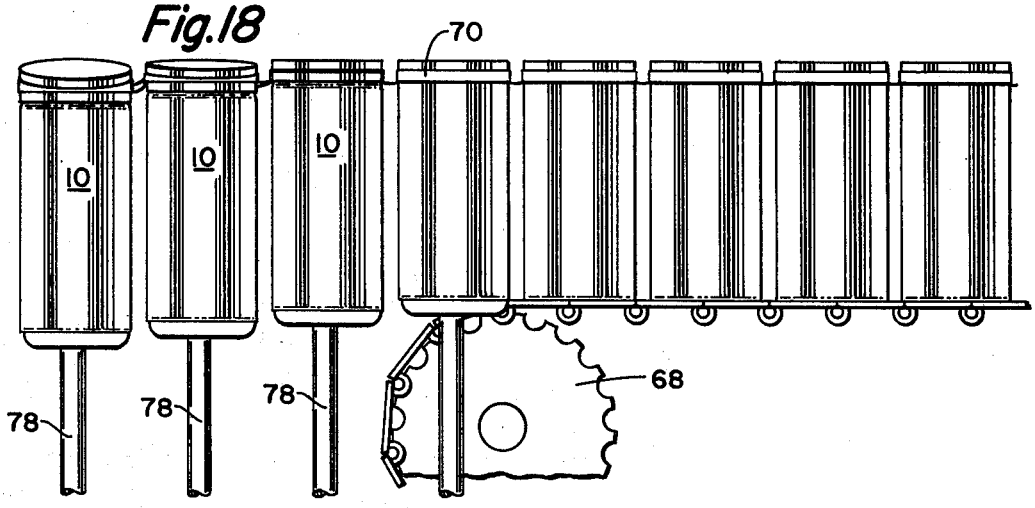
FIG. 18 is a view similar to that of FIG. 17 but showing an alternative form of conveyor for the intermediate row of containers.

When the outboard rows of containers 10 have been spread apart sufficiently to permit the intermediate row of containers 10 to enter therebetween, the intermediate conveyor 63 progressively moves the containers 10 of the intermediate row of containers 10 upwardly toward the strip 70 as shown in FIGS. 19–22. While the machine of FIGS. 14–22 essentially carries the intermediate row of containers 10 into contact with the intermediate row of carrier bands after the outboard carrier bands have been substantially completely applied, alternatively the intermediate row of containers 10 can be brought into contact with the strip 70 before complete application of the outboard carrier bands. Further alternatively, the intermediate row of containers 10 need not be carried into contact with the intermediate row of carrier bands at an angle such as shown in FIG. 17 but may be brought upwardly into contact with the strip 70 with the longitudinal axes of the containers 10 vertical as shown in FIG. 18. In many carrier strip embodiments, the angled entrance of the intermediate row of containers into the intermediate row of carrier bands is advantageous. In the machine embodiment shown in FIGS. 14–17, the angled entrance of the intermediate row of containers 10 is produced by the angle of the conveyor belt of the conveyor 63. FIG. 16 which is a top plan view of FIG. 17 further shows how the intermediate row of containers initially enter at an angle into the intermediate row of carrier bands of the carrier strip 70. FIG. 18, which is substantially diagrammatic, shows a plurality of reciprocating plungers 78 supporting the intermediate row of containers 10 and moving the containers 10 vertically upwardly into and through the apertures of the intermediate row of carrier bands of the strip 70. The plungers 78 may be carried in known forms of conveyors with the lower ends of the plungers 78 having cam rollers which will roll on a fixed cam plate there beneath to produce the desired vertically reciprocating motion as the plungers 78 are carried from the input to the output end of the machine in timed relation with the movement of the outboard containers 10 through the machine.

After complete application of the strip 70 to the three rows of containers 10 known cutting mechanisms may be provided at the output end of the machine above the output conveyors 67 for transversely severing the strip 70 between selected ranks of containers 10 to produce multipackages in any desired multiples of three containers.

Having described the invention, it is to be understood that changes can be made in the described embodiments by those skilled in the art within the spirit and scope of the claims.

1. The method of applying a continuous strip of elastic plastics material multipackaging devices over one end of a plurality of containers in which the strip comprises a plurality of end-to-end connected multipackaging devices each of which comprises two rows of band areas extending longitudinally thereof along the opposite outward sides thereof in ranks and in which each band area is circumferentially complete and of a peripheral dimension less than the outer circumferential dimension of each of the said plurality of containers adjacent said one end thereof, comprising the steps of:

arranging said plurality of containers in two rows and in ranks and moving said two rows in the direction of said rows and relatively inserting opposed outer sidewall portions of each successive rank of containers through said band areas of successive ones of said ranks of band areas and against the transversely outward band portions of said two rows of band areas of said strip of multipackaging devices with said strip of multipackaging devices in a transversely unstretched condition, continuing the movement of said two rows of containers and concurrently moving at least said opposed outer sidewall portions of each rank of said two rows of containers successively apart to urge said opposed outer sidewall portions of each successive rank of said containers against said outward band portions of said two rows of band areas to tension said multipackaging devices of said strip in directions transversely thereof, and continuing movement of said two rows of containers apart until the remainder of said two rows of band areas extending from said outward band portions slide over and about the remaining sidewall portions extending from said opposed outer sidewall portions of each rank of said containers.

2. An apparatus for applying an elastic plastics material multipackaging device over one end of a plurality of containers in which the multipackaging device comprises two rows of band areas extending longitudinally thereof along the opposite outward sides thereof in ranks and in which each band area is circumferentially complete and of a peripheral dimension less than the outer circumferential dimension of each of the said plurality of containers adjacent said one end thereof, said apparatus comprising means arranging said plurality of containers in two rows and in ranks and relatively inserting opposed outer sidewall portions of each rank of containers through said band areas of one of said ranks of band areas and against the transversely outward band portions of said two rows of band areas of said multipackaging device with said multipackaging device in a transversely unstretched condition, means for moving at least said opposed outer sidewall portions of each rank of said two rows of containers apart to urge said opposed outer sidewall portions of each rank of said containers against said outward band portions of said two rows of band areas to tension said multipackaging device in directions transversely thereof, and means for continuing movement of said two rows of containers apart until the remainder of said two rows of band areas extending from said outward band portions slide over and about the remaining sidewall portions extending from said opposed outer sidewall portions of each rank of said containers.

3. The method of applying an elastic plastics material multipackaging device over one end of a plurality of containers in which the multipackaging device comprises two rows of band areas extending longitudinally thereof along the opposite outward sides thereof in ranks and in which each band area is circumferentially complete and of a peripheral dimension less than the outer circumferential dimension of each of the said plurality of containers adjacent said one end thereof, comprising the steps of:

arranging said plurality of containers in two rows and in ranks and relatively inserting opposed outer sidewall portions of each rank of containers through said band areas of one of said ranks of band areas and against the transversely outward band portions of said two rows of band areas of said multipackaging device with said two rows of band areas of said multipackaging device in a transversely unstretched condition, moving at least said opposed outer sidewall portions of each rank of said two rows of containers apart to urge said opposed outer sidewall portions of each rank of said containers against said outward band portions of said two rows of band areas to tension said multipackaging device in directions transversely thereof, and thereafter applying a force against said multipackaging device between the containers of each rank of containers to force the remainder of the sidewall surface extending circumferentially of said containers from said one sidewall portion of each of said plurality of containers axially through one of said band areas of said two rows of band areas of said multipackaging device.

4. An apparatus for applying an elastic plastics material multipackaging device over one end of a plurality of containers in which the multipackaging device comprises two rows of band areas extending longitudinally thereof along the opposite outward sides thereof in ranks and in which each band area is circumferentially complete and of a peripheral dimension less than the outer circumferential dimension of each of the said plurality of containers adjacent said one end thereof, said apparatus comprising means arranging said plurality of containers in two rows and in ranks and relatively inserting opposed outer sidewall portions of each rank of containers through said band areas of one of said ranks of band areas and against the transversely outward band portions of said two rows of band areas said multipackaging device with said band areas of one of said ranks of band areas of said multipackaging device in a transversely unstretched condition, means for moving at least said opposed outer sidewall portions of each rank of said two rows of containers apart to urge said opposed outer sidewall portions of each rank of said containers against said outward band portions of said two rows of band areas to tension said multipackaging device in directions transversely thereof, and means for applying a force against said multipackaging device between the containers of each rank of containers to force the remainder of the sidewall surface extending circumferentially of said containers from said one sidewall portion of each of said plurality of containers axially through one of said band areas of said two rows of band areas of said multipackaging device.

5. The method of applying an elastic plastics material multipackaging device over one end of a plurality of containers in which the multipackaging device comprises at least three rows of band areas extending longitudinally of said device in ranks substantially perpendicular to said rows and in which each band area is circumferentially complete and the aperture thereof is elongated longitudinally of said device and the peripheral dimension of each aperture is less than the outer circumferential dimension of each of the said plurality of containers adjacent said one end thereof, comprising the steps of:

arranging a portion of said plurality of said containers in two adjacent rows and in ranks and relatively inserting opposite outer sidewall portions of each rank of said containers in said two rows through said band areas of one of said ranks of band areas of the two rows of band areas extending along the longitudinal side margins of said multipackaging device and against the transversely outward band portions of said two rows of band areas of said multipackaging device with said multipackaging device in a transversely unstretched condition, moving at least said opposed outer sidewall portions of each rank of said two rows of containers apart to urge said opposed outer sidewall portions of each rank of said two rows of containers against said outward band portions of said two rows of band areas to tension said multipackaging device in directions transversely thereof with a concurrent transverse stretching of the intermediate band areas between said two rows of band areas of said multipackaging device, applying a force against said multipackaging device between the containers of each rank of said two rows of containers to force the remainder of the sidewall surface extending circumferentially of said containers from said one sidewall portion of each of said containers axially through one of said band areas of said two rows of said band areas of said multipackaging device, arranging a further portion of said plurality of containers in a number of intermediate rows equal to the number of rows of intermediate band areas between said two rows of band areas of said multipackaging device, moving said intermediate rows of containers axially and between said two rows of containers toward said rows of intermediate band areas until said one end of each of said intermediate rows of containers is axially inserted through one of said band areas of said intermediate rows of band areas of said multipackaging device.

6. An apparatus for applying an elastic plastics material multipackaging device over one end of a plurality of containers in which the multipackaging device comprises at least three rows of band areas extending longitudinally of said device in ranks substantially perpendicular to said rows and in which each band area is circumferentially complete and the aperture thereof is elongated longitudinally of said device and the peripheral dimension of each aperture is less than the outer circumferential dimension of each of the said plurality of containers adjacent said one end thereof, said apparatus comprising means for arranging a portion of said plurality of said containers in two adjacent rows and in ranks and relatively inserting opposite outer sidewall portions of each rank of said containers in said two rows through said band areas of one of said ranks of band areas of the two rows of band areas extending along the longitudinal side margins of said multipackaging device and against the transversely outward band portions of said two rows of band areas of said multipackaging device with said multipackaging device in a transversely unstretched condition, means for moving at least opposed outer sidewall portions of each rank of said two rows of containers apart to urge said opposed outer sidewall portions of each rank of said two rows of containers against said outward band portions of said two rows of band areas to tension said multipackaging device in directions transversely thereof with a concurrent transverse stretching of the intermediate band areas between said two rows of band areas of said multipackaging device, means for applying a force against said multipackaging device between the containers of each rank of said two rows of containers to force the remainder of the sidewall surface extending circumferentially of said containers from said one sidewall portion of each of said containers axially through one of said band areas of said two rows of said band areas of said multipackaging device, means for arranging a further portion of said plurality of containers in a number of intermediate rows equal to the number of rows of intermediate band areas between said two rows of band areas of said multipackaging device, and means for moving said intermediate rows of containers axially and between said two rows of containers toward said rows of intermediate band areas until said one end of each of said intermediate rows of containers is axially inserted through one of said band areas of said intermediate rows of band areas of said multipackaging device.

7. The method of applying a stretchable plastics material multipackaging device which includes a plurality of parallel rows of looped band sections to one end of each container of two rows of containers and in which the circumferential dimension of the inner periphery of each of the looped band sections is less than the outer circumferential dimension of said one end of each of said containers, comprising the steps of:

positioning said two rows of containers with said containers aligned in ranks perpendicular to the direction of said rows and with the longitudinal axes of said containers substantially parallel and vertical, tilting the containers in each row of said two rows of containers in opposite directions in planes perpendicular to the longitudinal direction of said rows to align said one end of the containers in said two rows of containers closer together than the other end of said containers of said two rows of containers, aligning said multipackaging device with the longitudinal central axis thereof extending longitudinally centrally of said two rows of containers and applying each of the transversely outward band portions of said looped band sections of the two rows of bands extending along the outer longitudinal sides of said multipackaging device over said one end of each of said containers with said outer band portions engaging the furthermost spaced-apart outer sidewall surfaces of each rank of said containers in said two rows of containers, tilting the containers in each row of said two rows of containers in opposite directions in said planes perpendicular to the direction of said rows to realign said containers with the longitudinal axes of said containers parallel and vertical, and relatively pushing against said multipackaging device between said outer side bands in a vertical direction and toward said containers until each of the other side bands circumferentially encircles one of said containers.

8. In the method as defined in claim 7, wherein said plurality of parallel rows of looped band sections of said multipacking device comprises more than two rows of looped band sections, the further method of applying each looped band section of an intermediate row of looped band sections between said outer side rows of looped band sections to one end of each container of an intermediate row of containers, comprising the steps of:

thereafter moving and holding said two rows of containers apart until the multipackaging device applied thereto is substantially taut, and thereafter applying at least a holding force on said multipackaging device between said two rows of containers and on each side of said intermediate row of looped band sections and relatively moving said intermediate row of containers and said intermediate row of looped band sections together until each of said looped band sections of said intermediate row of looped band sections circumferentially encircles one of said intermediate containers.

9. The method of applying a stretchable plastics material multipackaging device which includes two rows of looped bands extending longitudinally along the outer sides of said device and in transverse ranks to two rows of containers wherein said bands of the device in initial unstretched condition have an inner peripheral dimension less than the outer circumferential dimension of said containers, comprising the steps of:

linearly moving said two rows of containers with said containers aligned in ranks perpendicular to the direction of movement and with the longitudinal axes of said containers parallel, successively tilting each rank of containers in opposite directions in planes perpendicular to the direction of movement to successively align adjacent ends of said containers in each rank with the furthermost spaced apart a distance less than the distance between the furthermost spaced apart portions of the inner peripheries of the bands in each rank of bands of said device in initial unstretched condition, successively applying each rank of bands of said device in initial unstretched condition over said tilted aligned adjacent ends of said containers in each rank of containers with the furthermost spaced apart portions of the inner peripheries of the bands against the outer sidewall surfaces of said containers, successively tilting each rank of containers in opposite directions in said planes perpendicular to the direction of movement after application of said furthermost space-apart portions of the inner peripheries of the bands of said device to realign said containers with the longitudinal axes of said containers parallel, and successively relatively pushing against said device between the bands of each rank of bands until each of said bands circumferentially encircles one of said containers.

10. The method of continuously applying a strip of indeterminate length of a stretchable plastics material which strip includes two rows of looped bands extending longitudinally along the outer sides of said strip and in transverse ranks to two rows of containers wherein said bands of the strip in initial unstretched condition have an inner peripheral dimension less than the outer circumferential dimension of said containers, comprising the steps of:

continuously linearly moving said two rows of containers with said containers aligned in ranks perpendicular to the direction of linear movement and with the longitudinal axes of said containers parallel, during said movement successively tilting each rank of containers in opposite directions in planes perpendicular to said direction of linear movement to successively align adjacent ends of said containers in each rank with the furthermost spaced apart portions of said adjacent ends of said containers being spaced apart a distance less than the distance between the furthermost spaced apart portions of the inner peripheries of the bands in each rank of bands of said strip in initial unstretched condition, continuously successively applying each rank of bands of said strip in initial unstretched condition over said adjacent ends of said containers in each rank of containers with the furthermost spaced apart portions of the inner peripheries of the bands against the outer side wall surfaces of said containers as each rank of containers is tilted and aligned as described in the foregoing step, thereafter, during said linear movement continuously successively tilting each rank of containers in opposite directions in planes perpendicular to the direction of linear movement to continuously realign said containers with the longitudinal axes of said containers parallel, and continuously and substantially contemporaneously with the immediately foregoing step relatively pushing said strip between the bands of each rank of bands toward said containers until each of said bands circumferentially encircles one of said containers.

11. An apparatus for applying an elastic plastics material multipackaging device over one end of a plurality of containers in which the multipackaging device includes two rows of band areas extending longitudinally thereof along the outward sides thereof in which each band area is circumferentially complete and of a peripheral dimension less than the outer circumferential dimension of each of said plurality of containers adjacent said one end thereof, said apparatus comprising a work station, means in said work station for arranging said plurality of containers in two rows and for relatively inserting one side wall portion adjacent said one end of each of said plurality of containers axially through one of said band areas and against the transversely outward band portions of said two rows of band areas of said multipackaging device, means in said work station for urging said one sidewall portion of each said containers against said outward band portions of said two rows of band areas to tension said multipackaging device in directions transversely thereof, and means in said work station for tilting said two rows of containers in opposite directions and relative to said tensioned multipackaging device to force the remainder of the sidewall surface extending circumferentially of said containers from said one sidewall portion of each of said plurality of said containers axially through one of said band areas of said multipackaging device.

12. An apparatus for applying a stretchable plastics material multipackaging device which includes a plurality of parallel rows of looped band sections to one end of each of the containers of two rows of containers and in which the circumferential dimension of the inner periphery of each of the looped band sections is less than the outer circumferential dimension of said one end of each of said containers, said apparatus comprising a work station, means in said work station for positioning said two rows of containers with said containers aligned in ranks perpendicular to the direction of said rows and with the longitudinal axes of said containers substantially parallel and vertical, means in said work station for tilting the containers in each row of said two rows of containers in opposite directions in planes perpendicular to the longitudinal direction of said rows to align said one end of the containers in said two rows of containers closer together than the other end of said containers of said two rows of containers, means in said work station for aligning said multipackaging device with the longitudinal center axis thereof extending longitudinally centrally of said two rows of containers and for applying each of the transversely outward band portions of said looped band sections of the two rows of bands extending along the outer longitudinal sides of said multipackaging device over said one end of each of said containers with said outward band portions engaging the furthermost spaced apart outer sidewall surfaces of each ranks of said containers in said two rows of containers, means in said work station for tilting the containers in each row of said two rows of containers in opposite directions in said planes perpendicular to the direction of said rows to realign said containers with a longitudinal axes of said containers parallel and vertical and with said multipackaging device applied thereto, and means in said work station for applying a force against said multipackaging device between said outer side bands in a vertical direction and toward said containers to cause each of said looped band sections to circumferentially encircle one of said containers.

13. In an apparatus as defined in claim 12, wherein said plurality of parallel rows of looped band sections of said multipackaging device comprises more than two rows of looped band sections, said apparatus further comprising conveyor means for moving said two rows of containers with said multipackaging device applied thereto from said work station into a second work station, means in said second work station for holding said two rows of containers transversely apart to render said multipackaging device taut therebetween, means in said second work station for moving an intermediate row of containers between said two rows of containers axially toward and into engagement with an intermediate row of looped band sections of said multipackaging device between said two rows of looped band sections with each of said intermediate containers in axial alignment with one of said looped band sections of said intermediate row of looped band sections, and means in said second work station for applying at least a holding force on the opposite side of said multipackaging device from the side thereof engaged by said intermediate row of containers and at positions spaced transversely outwardly of said intermediate row of looped band sections to enable each of said containers of said intermediate row of containers to move relatively axially through one of said looped band sections of said intermediate row of looped band sections.

14. An apparatus for continuously applying a strip of indeterminate length of a stretchable plastics material which strip includes two rows of looped bands extending longitudinally along the outer sides of said strip and in transverse ranks to two rows of containers wherein said bands of the strip in initial unstretched condition have an inner peripheral dimension less than the outer circumferential dimension of said containers, said apparatus comprising an input conveyor continuously linearly moving said two rows of containers with said containers aligned in ranks perpendicular to the direction of movement of said containers and with the longitudinal axes of said containers parallel, a first work station in said apparatus receiving said two rows of containers from said input conveyor and having tilting and conveying means for moving said containers through said first work station and successively tilting each rank of containers in opposite directions in planes perpendicular to the direction of movement of said two rows of containers through said first work station to successively align adjacent ends of said containers in each rank of containers with the furthermost space apart portions of said adjacent ends of said containers being spaced apart a distance less than the distance between the furthermost spaced apart portions of the inner peripheries of the bands in each rank of bands of said strip in initial unstretched condition, means in said apparatus for continuously successively applying each rank of bands of said strip in initial unstretched condition over said adjacent ends of said containers in each rank of containers in said first work station with the furthermost spaced apart portions of the inner peripheries of the bands against the outer sidewall surfaces of said containers, a second work station at the outboard end of said first work station and said second work station including means for conveying said two rows of containers from said first work station therethrough and for continuously successively tilting each rank of containers in opposite directions in planes perpendicular to the direction of linear movement through said second work station to continuously successively realign said containers with the longitudinal axes of said containers parallel, and means in said second work station for relatively pushing said strip between the bands of each rank of bands towards said containers until each of said bands circumferentially encircles one of said containers.

15. In an apparatus as defined in claim 14, wherein said strip of stretchable plastics material further includes at least one row of intermediate looped bands between said two rows of looped bands, said apparatus further comprising second conveyor means receiving said two rows of containers with said strip applied thereto from said second work station and for moving said two rows of containers in the linear direction of said applied strip and transversely apart to an extent rendering said strip between said two rows of containers substantially taut, means in said apparatus between and below said second conveyor means for moving an intermediate row of containers in the longitudinal direction of said strip and axially toward said taut strip between said two rows of containers and into engagement with said intermediate row of looped bands of said strip with each of said intermediate containers in axial alignment with one of said looped bands of said intermediate row of looped bands, and means in said apparatus for applying at least a holding force on the opposite side of said strip from the side thereof engaged by said intermediate row of containers and at positions spaced transversely outwardly of said intermediate row of looped bands to enable each of said containers of said intermediate row of containers to move relatively axially through one of said looped bands of said intermediate row of looped bands.

* * * * *